US006216622B1

(12) United States Patent
Lindstrom et al.

(10) Patent No.: US 6,216,622 B1
(45) Date of Patent: Apr. 17, 2001

(54) BOAT HULL WITH CENTER V-HULL AND SPONSONS

(75) Inventors: Albert K. Lindstrom, Sequim; John R. Kirkham, Clinton, both of WA (US)

(73) Assignee: N.P.M. Holdings, Inc., Seattle, WA (US)

( * ) Notice: Subject to any disclaimer, the term of this patent is extended or adjusted under 35 U.S.C. 154(b) by 0 days.

(21) Appl. No.: 09/151,250

(22) Filed: Sep. 10, 1998

Related U.S. Application Data

(60) Provisional application No. 60/058,346, filed on Sep. 10, 1997.

(51) Int. Cl.[7] ..... B63B 1/00

(52) U.S. Cl. ..... 114/61.33; 114/61.26; 114/288

(58) Field of Search ..... 114/271, 288, 114/289, 290, 291, 56.1, 61.2, 61.26, 61.32, 61.33; D12/310, 313, 314

(56) References Cited

U.S. PATENT DOCUMENTS 4,708,085 * 11/1987 Blee ..... 114/291
5,339,761 * 8/1994 Huang ..... 114/291
5,452,676 * 9/1995 Fiore ..... 114/291

* cited by examiner

*Primary Examiner*—Stephen Avila
(74) *Attorney, Agent, or Firm*—Garrison & Associates PS; David L. Garrison

(57) ABSTRACT

A high performance boat hull structure is provided which combines a V-hull bottom portion 12 with mid hull sponsons 31 and 33 which form longitudinal tunnels with adjacent structures. The mid hull sponsons 31 and 33 have horizontally disposed running surfaces to provide lift at high speeds. Outer sponsons 14 and 16 incorporate running surfaces 24 and 26 and together with mid hull sponsons 31 and 33 form a second air tunnel and engage and deflect side directed spray and wake downwardly providing additional lift and decreasing or eliminating spray and signature wake. Entrance of injected or inducted air into the air tunnel area decreases frictional engagement of the hull with water to improve efficiency and ride.

11 Claims, 11 Drawing Sheets

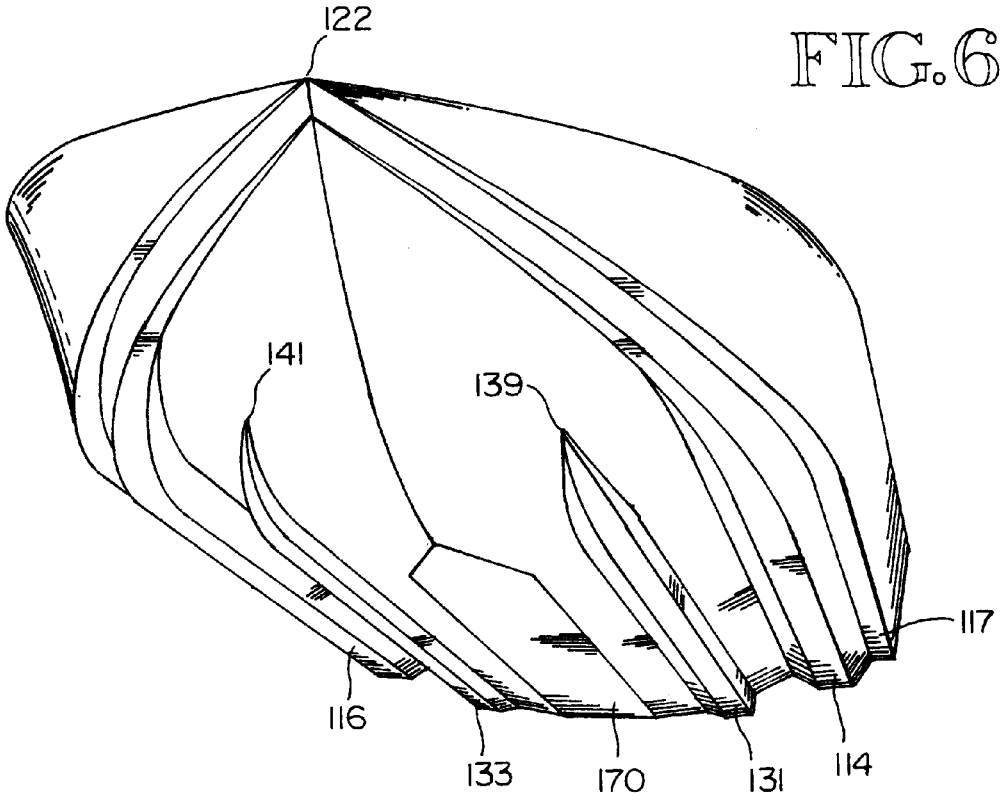
FIG. 6
FIG. 7
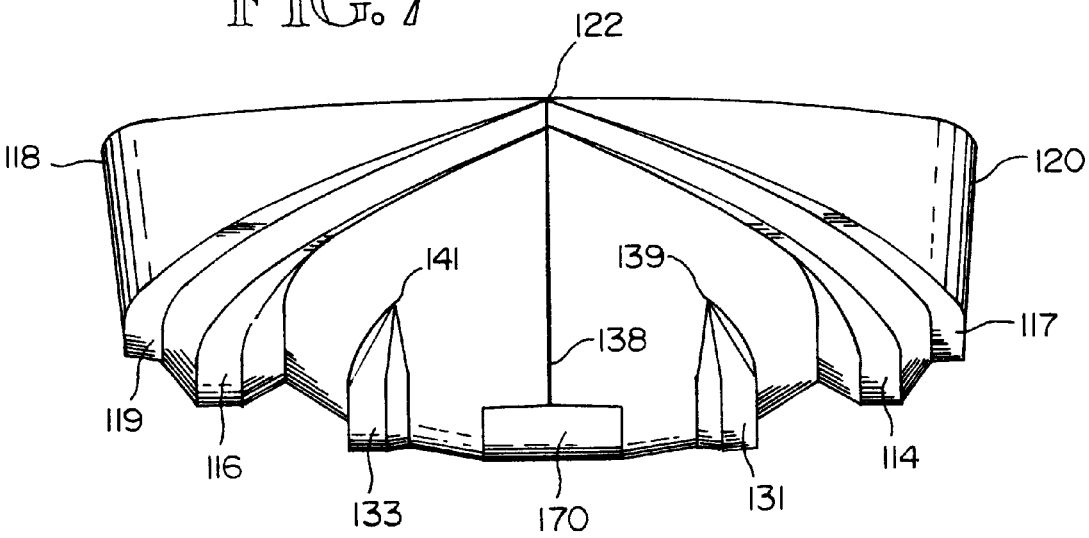

420
414
431a
431
422
438
433
433a
416
418
422
90
438

BOAT HULL WITH CENTER V-HULL AND SPONSONS

This application claims the benefit of U.S. Provisional Application Ser. No. 60/058,346, entitled "Boat Hull With Center V-Hull Sponsons" and filed Sep. 10, 1997.

TECHNICAL FIELD

This invention relates to high performance boat hull structures. In particular, it pertains to an advanced hull structure which improves upon the handling characteristics of a V-bottom hull by combining V-bottom characteristics with those of a flat bottom planing hull combined with the speed and acceleration characteristics of a tunnel hull boat with a further improvement of substantially flat progressive lift surfaces with multiple tunnel and multiple reverse deadrise hydrochines providing surfaces upon which the hull predominantly rides at higher speeds, while providing lower speed running surfaces for mid speed optimal performance. These advanced features may be further combined with forced and natural air movement along the hull-water interface to provide added lift and control at low and high speeds.

BACKGROUND OF THE INVENTION

Tunnel hull boats are designed to trap air underneath the boat hull as the boat moves through water, thereby compressing the air and lifting the boat above the water line defined by the boat's natural buoyancy. The effect of lifting the boat decreases the boat's resistance through the water and allows for faster acceleration and greater boat speeds.

Conventional tunnel hull designs have inherently sacrificed handling characteristics for higher speed performance. In particular, the same hull design that has allowed for lifting the hull out of the water has inhibited banking of the boat when turned, and contributes to porpoising (up and down oscillation of the bow) while turning. Moreover, performance of conventional tunnel hull boats is load sensitive and sea state dependent. That is to say, heavy loads detract from the air capturing and speed enhancing ability of tunnel hull boats, and, as compared to the more traditional V-bottom hull boat, tunnel hull boats are less stable in choppy water. V-bottom displacement hull boats inherently and inefficiently displace water outwardly in spray and excersive wake.

A high performance boat that combines the speed and acceleration advantages of the tunnel hull with the handling characteristics and stability of the traditional V-bottom hull and certain of the ride characteristics of a sled or flat bottomed hull would provide decided advantages.

SUMMARY OF THE INVENTION

The improved boat hull in accordance with the present invention incorporates progressional lift, multiple tunnel, multiple reverse deadrise hydrochines, spoon bow, and spray knocker attributes in a modified V-hull wherein the positioning and configuration of the multiple hydrosponsons successfully utilizes side defected spray and wake to enhance lift, thereby combining the high performance capabilities of the tunnel hull with the handling and stability characteristics of the traditional V-bottom hull. An objective of this invention is to provide for predetermined variable geometry of the hull-water interface for various velocities of the boat through the water. The hull design is carried out in such a manner as to result in a faster, more stable and efficient hull when operated under a variety of speeds, sea conditions and weight loading and distribution. The hull in accordance with the present invention includes a substantially V-shaped center hull portion, and one or more opposed pairs of narrow mid-hull sponsons having a substantially horizontally disposed running surface thereon which provides a part of the lift at high speeds, and a pair of outer hydrosponsons that depend downwardly from the gunwales to an outer low-speed a running surface which also functions as a splash shield at higher speeds. Running surfaces on the bottom of each mid-hull sponson and the pair of outer hydrosponsons may be positioned at a substantially horizontal attitude varying up to about 10 degrees from the horizontal as desired to modify the ride, a harsher ride being obtained at near horizontal disposition of the running surfaces with a softer ride obtained with a higher angulation of the surfaces. The above described positioning of the sponson running surfaces allows for controlled banking of the boat when turned, yet provides an adequate air trap for tunnel hull performance. The narrow width of the running surface on the sponsons and the angulation of the running surfaces are engineered to provide the required stability and ride characteristics with a substantial decrease in the wetted surface area of the overall hull during high speed operation. Locatized air injection may add to the desirable operational characteristics of this hull by modifying the wetted area and decreasing the friction of the hull traversing the water while providing added lift and control.

The hull designed according to the teachings of this invention exhibits increased structural strength, especially due to the continuous longitudinal beam structure of the sponsons extending along most of the length of the boat hull, and a wider than conventional beam providing better stability with lowered power requirements to obtain the same speed and performance. Lower speeds provide planing of the hull and a softer ride is achieved due to the multiple tunnel structure with running surfaces designed to provide optimum lift. The wider hull with hydrosponsons along a large portion of the hull results in less draft for shallow water operation, while having a higher weight capacity as compared to conventional hull designs. At higher speeds the hull of this invention performs with greater stability, exhibiting a flatter, more stable turning ability with higher speeds attainable in turns. Finally, the hull described herein utilizes side-directed spray and wake to enhance lift thereby enhancing efficiency and exhibiting significantly less wake than conventional boat hulls.

Very large hull structures for cargo and navy vessels may be advantageously designed using a multiplicity of parallel sponsons with running surfaces thereon to define many tunnels positioned across the width of the large hull.

BRIEF DESCRIPTION OF THE DRAWINGS

FIG. 6 is a perspective view similar to FIG. 1 showing a second embodiment of the invention having a central flat running surface in place of a portion of the V-hull;

FIG. 7 is a front elevational view of the boat hull shown in FIG. 6;

DETAILED DESCRIPTION OF THE DRAWINGS

Figure 1:
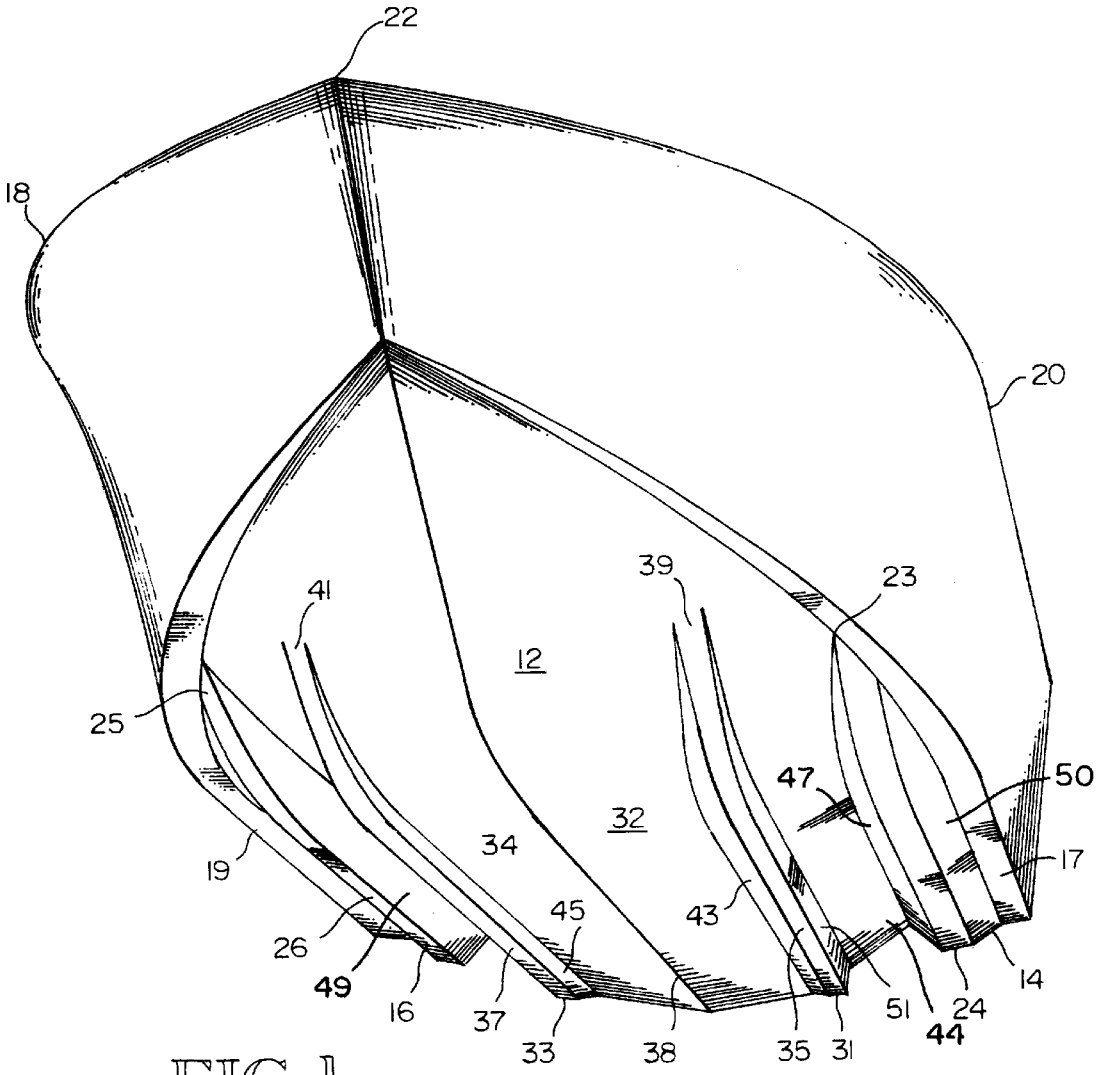
FIG. 1 is a perspective view of one embodiment of the boat hull constructed in accordance with the present invention taken from a point below and ahead of the bow.

Referring to the drawings, an improved hull 10 in accordance with the present invention broadly includes center V-hull portion 12, and a pair of opposed, generally parallel outer sponsons 14, 16 positioned to either side of the V-hull portion 12. Outer low speed running surfaces 17, 19 extend from the bow 22 to the stern 28 at the lower margins of respective opposed gunwales 18, 20. Running surfaces 17 and 19 also serve to interrupt and deflect part or all of the splash and spray from adjacent parts of the hull. Positioned adjacent running surfaces 17, 19, the sponsons 14, 16 extend rearwardly from sponson points 23 and 25 aft of the bow 22 and terminate at stern 28. Sponsons 14 and 16 have a running surface 24 and 26 respectively at the lowermost extent thereof, extending along the length of each sponson and positioned in a near horizontal plane as is more fully described below.

One or more pairs of mid-hull sponsons may be positioned between outer sponsons 14, 16 and keel 38. In the figures, one pair of mid-hull sponsons 31, 33 are shown depending from the generally V-hull, with a reverse deadrise and mid-hull sponson running surfaces 35, 37.

The V-hull portion 12 of hull 10 is defined by inclined panels 32, 34 which extend rearwardly from the bow transition area to the stern 28, and from keel to reverse deadrise 43 and 45 forming the keelward surface of mid-hull sponsons 31 and 33.

Figure 2:
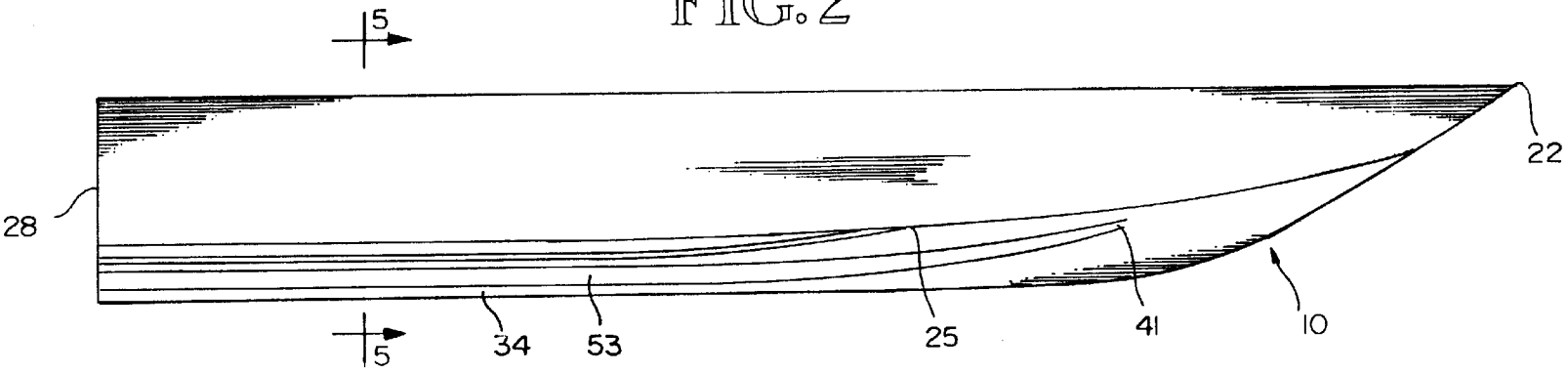
FIG. 2 is a side elevational view of the hull shown in FIG. 1.
Figure 3:
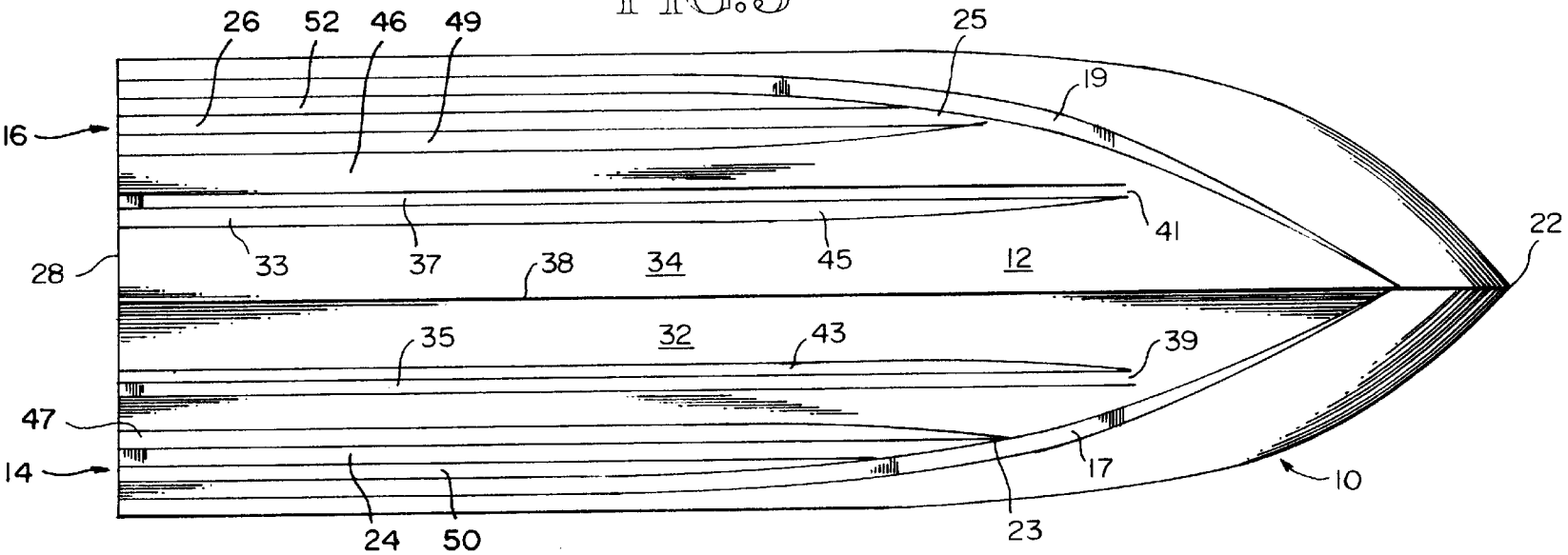
FIG. 3 is a bottom elevational view of the hull shown in FIG. 1.
Figure 4:
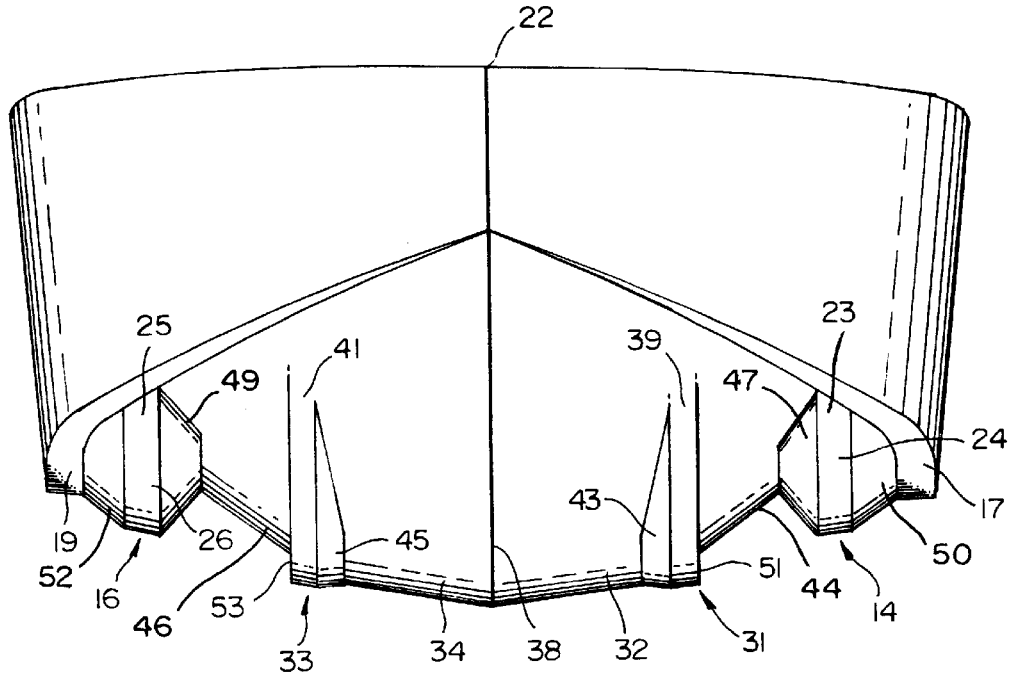
FIG. 4 is a front elevational view of the hull shown in FIG. 1.
Figure 5:
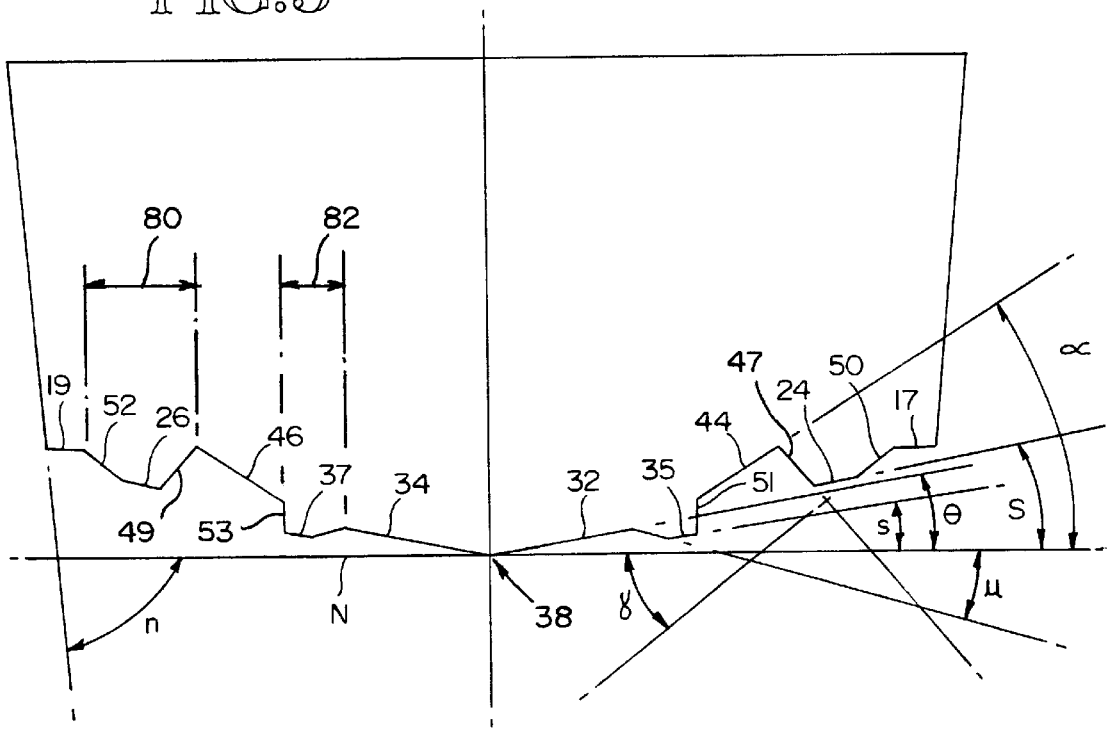
FIG. 5 is a schematic cross sectional view taken along lines 5—5 of FIG. 2.
Figure 8:
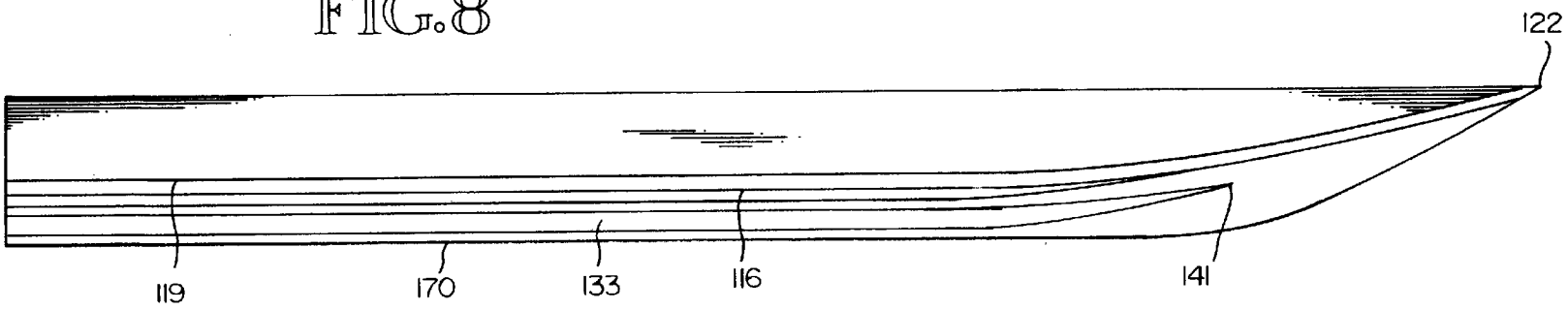
FIG. 8 is a side elevational view of the boat hull shown in FIG. 6.
Figure 9:
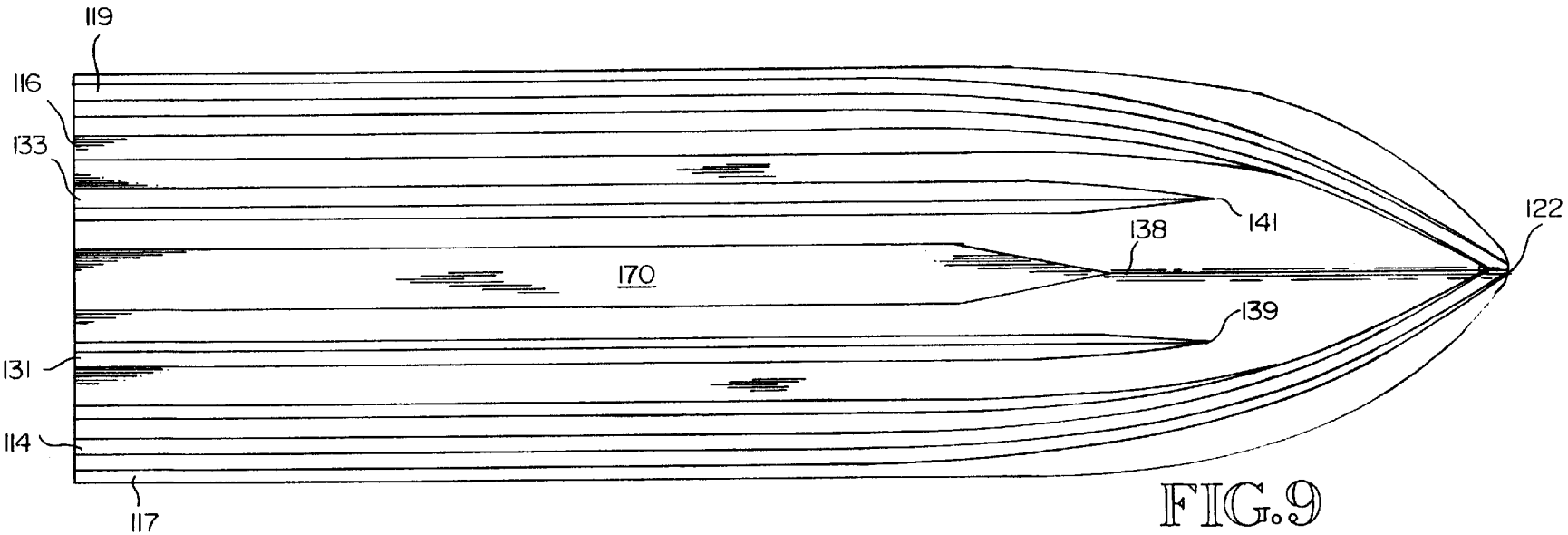
FIG. 9 is a bottom plan view of the boat hull shown in FIG. 6.

Referring to the schematic drawing shown in FIG. 5, which is an elevational cross section at line 5—5 of FIG. 2 and viewing along the central axis of the hull, the panels 32, 34 define the dead rise angle of the V-hull portion 12 of the boat hull 10. The panels 32, 34 are symmetrically positioned about the hull center plane H. The V-hull dead rise angle that is measured from the normal plane N containing the apex 38 and perpendicular to the hull center plane H, to the respective V-hull panel portion 32, 34 is approximately in the range of 5–15 degrees and preferably approximately 7 degrees. It will be appreciated that the angles defined by panels 32, 34 with the horizontal plane N may increase as the panels move forward from a point approximately midships on the hull. The V-hull dead rise angle is properly measured aft of the midship's point, where the angle defined by the panels with the horizontal is relatively constant. The V-hull portion 12 terminates in a generally vertical transom 28.

At the margins of panels 32, 34 a pair of mid-hull sponson-like elongated structures extending from mid-hull sponson points 39, 41 to transom or stern 28. Reverse deadrise 43, 45 are angled in the range of 0 to minus 10 degrees and preferably at about minus 5 degrees with respect to horizontal plane N, and fair into mid-hull sponson running surfaces 35, 37 which extend along the length of mid-hull sponsons 31, 33. Substantially vertical panels 51, 53 extends upwardly from running surfaces 35, 37 to outer V-panels 44, 46 which are angled at a deadrise angle of from 30 to 40 degrees and preferably about 35 degrees from horizontal plane N. A second reverse deadrise panel 47, 49 extend downwardly from said outer V-panels 44 and 46 defining interior surfaces of outer sponsons 14 and 16. Sponsons 14 and 16 extend from sponson points 23, 25 to the transom or stern 28. Outer sponson exterior panels 50, 52 extend along the length of outer sponsons 14, 16 and are connected to second reverse deadrise panels 47, 49 by running surfaces 24, 26. Running surfaces 24, 26 are designed to provide sufficient lift to the hull for planing purposes at mid speeds and are angled with respect to the horizontal plane N in the range of approximately 0 to 20 degrees and preferably at about 10 degrees. The sponsons intercept side directed spray and wake from the V-hull portion and direct them downwardly to enhance lift and reduce signature wake.

A combined splash rail and low speed running surface is positioned at the upper margin of each outer sponson exterior panel 50, 52 and preferably extends from bow to stern of the hull with an angle for the surfaces 17, 19 being approximately 0 to 10 degrees and preferably about 4 degrees from the horizontal plane N. Gunwales 18, 20 extend upwardly from surfaces 17, 19 and may be substantially vertical or flare outwardly as desired. The splash sail intercepts splash and wake and directs them downwardly, resulting in both added lift for the boat and further reduction or elimination or signature wake.

The sponsons 14, 16, and V-hull portions 44, 46 define a pair of opposed, longitudinally extending tunnels, with the water providing the tunnel bottom wall.

The unique handling characteristics of the hull 10 in accordance with the present invention are in large part due to the placement of the outer sponsons 14, 16 relative to the dead rise angle of the outer V-hull panels 44, 46, coupled with the mid-hull sponsons and their placement with respect to V-panels 32, 34. Capture and redirection of spray and wake downwardly contribute to the unique handling characteristics of the hulls constructed according to this invention.

The lower limit of the outer sponson base line is established by yew stability requirements. The V-hull panels 44, 46 inherently counteract forces transverse to the forward path of travel of the boat, and maintains the boat in a single, forward direction. Lowering the outer sponson base line as shown allows the natural buoyancy and upward planing force of the sponsons to counteract the inherent, positive yaw stability characteristic of the V-hull.

The upper limit of the mid hull and outer sponson base lines are established by the depth of each sponson required to provide an adequate air capturing and air-compressing tunnel. As will be appreciated by those skilled in the art, the cross section area of the forward end of a boat hull tunnel must be greater than the cross section area at the rear end of the tunnel for compression of air traveling down the tunnel as the boat travels through the water. The compression of air within the tunnel creates the desired result that, as a boat travels through the water, the bow will rise until planing speed is attained, and, to provide the desired air compression effect, the leading edge of the sponson must be low enough to intersect the water line at a point far enough forward on the hull to define an air capturing tunnel of adequate length. On the other hand, it is not desirable to submerge any more of the outer sponson than is necessary to effect proper tunneling, in order to avoid unduly increasing the wetted hull perimeter and related skin drag. A sponson depth that is not higher than about two-thirds the V-hull dead rise angle has been found to provide a tunnel of adequate length for air compression purposes, while minimizing the wetted surface area of the sponson. Interception and downwardly direction of the spray and wake is accomplished with the sponson configured as described.

The shape of the sponsons 14, 16 is unique in several aspects other than the angles described and the presence of the outer splash rail and running surface 17, 19.

The width of sponson base panels 80, 82, and the preferred angle of the vertical rise of the outer sponson sidewalls is determined by several competing factors. In particular, the sponson sidewalls and bottom wall preferably defines a sponson width that provides a certain, limited amount of lift to the hull due to buoyancy spray interception and hydraulic planing effects. The displacement lift provided by the sponsons enhances the boat's stability at rest and at slow speeds. At high speeds, however, the displacement lift effect of the sponsons is preferably minimal, allowing the boat to maneuver in the manner combining the characteristics of a tunnel hull with a traditional V-hull boat. Redirection of spray and wake provides significant control and lift and higher speed. The result is a highly stable and maneuverable boat.

The maximum design width of the outer sponsons is determined by the planing effect provided by the mid hull and outer sponsons as the boat moves through the water. Water flow past the sponsons can be either laminar or turbulent with efficiency enhanced by turbulent flow with air bubbles at the hull-water interface. The laminar or turbulent characteristic of the flow is a function of boat speed and geomretry of the sponson; in particular, the geometry of the sponson effective base width. The addition of forced air flow to the hull surface as is described below remarkably effects the performance characteristics of the hull.

The sponson effective base width is determined by the effective cross sectional area of the sponson in the plane of flow. Referring to the drawings, the effective cross sectional area of the sponson is a combination of the planar base panels on outer panels 50, 52. Those skilled in the art will appreciate that, as the angle of each outer panels 50, 52 decreases, as measured from the horizontal, the area of the outer sidewall presented to the plane of water flow increases, and accordingly the planing effect of the sponson outer sidewall also increases.

The minimum width of the outer sponsons is determined by the need for the sponsons to provide some buoyancy to stabilize the boat when the boat is at rest. Buoyancy is a function of displaced water (volume of the sponson). The shape of the sponson inner sidewalls and the minimum angle of the sponson outer sidewall, relative to the horizontal, are determined by desired turning characteristics, and the planing effect, respectively. Moreover, the maximum sponson effective planar base width is determined by desired sponson lift characteristics. The length and depth of the sponsons are determined by the need to have an air tunnel of appropriate length (see above). The volume of the sponsons (i.e., water displacement capability) can therefore be controlled only by varying effectively the planar base panel width, and by varying the sponson outer sidewall angle. Effective volume of the sponsons is primarily controlled by varying the width of sponson running surfaces 24, 26.

As noted above, the angular configuration of the surfaces forming the mid hull sponsons 31, 33 and the outer sponsons 14, 16 may be varied somewhat to accommodate different load and ride characteristics. The operational and preferred ranges of dimensions and angles for the component parts of the hull are set out below, with particular reference to FIGS. 1–5.

| Angle | Operable Range | Preferred Range | Most Preferred Range |
|---|---|---|---|
| α | 10°–40° | 30°–40° | 35°–37° |
| β | 0°–15° | 0°–10° | 5°–7° |
| γ | 20°–50° | 30°–45° | 35°–40° |
| δ | −5°–15° | 0°–10° | 6°–8° |
| θ | 0°–15° | 2°–10° | 5°–7° |
| ζ | −5°–15° | 0°–10° | 2°–4° |
| μ | 30°–90° | 40°–60° | 45°–55° |
| η | 70°–90° | 80°–90° | 80°–90° |

Surfaces 17, 19, which constitute the outer sponsons margin, may be configured as shown in FIG. 5 at the preferred angular range to the horizontal of about 2°–5°. The operable range may extend from −5° to 15°. Additionally, to further control splash, the surfaces 17, 19 may include a downwardly projecting member, or a wedge shaped member thereon to redirect the spray downwardly, if desired, over part or all of the length of hydrosponsons 24, 26. Alternatively, the modifications mentioned to surfaces 17, 19 may extend over part or all of the length of the boat, including the bow portion thereof.

The alternative embodiments of this invention shown in FIGS. 6–20 have most elements in common with the first embodiment shown in FIGS. 1–5 and described in detail above. When a more nearly flat bottom type performance is needed the embodiment shown in FIGS. 6–9 may be used, in which the rearward central area of the hull is configured with a flat horizontal panel 170 extending from the juncture of the bow and main hull rearwardly to the stern. Panel 170 may be varied in area to achieve the performance needed, for example for a greater buoyancy and less draft, the panel 170 would be larger, whereas, if performance more nearly resembling a V-hull is desired, the panel 170 would be smaller. Other elements of the embodiment shown in FIGS. 6–9 are similar to comparably disposed elements shown in FIGS. 1–5 and are similarly labeled, prefaced with the number "1".

Figure 10:
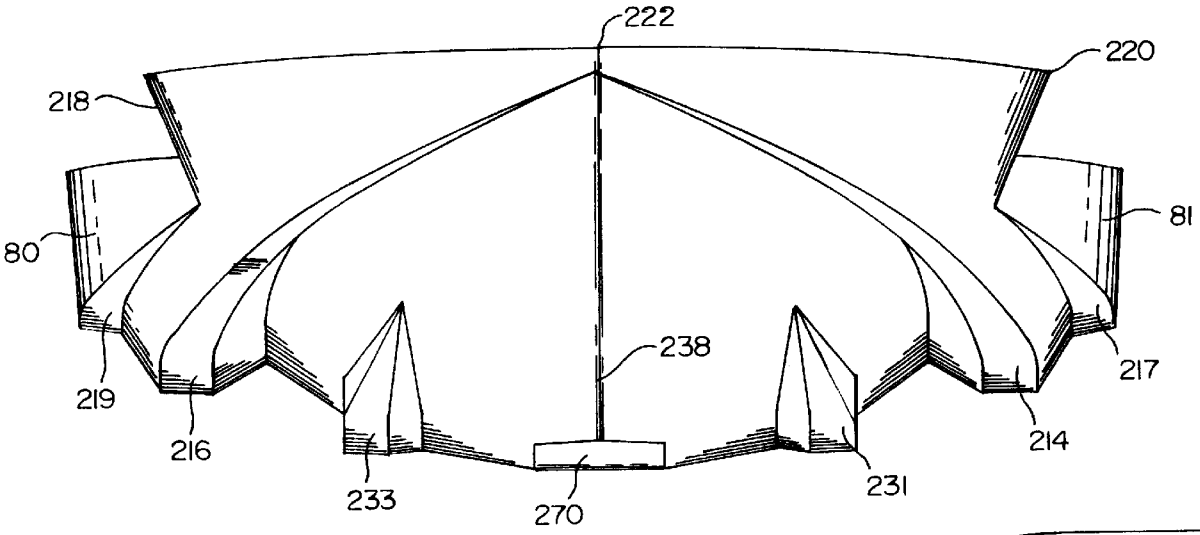
FIG. 10 is a front elevational view of a boat hull showing a third embodiment of the invention.
Figure 11:
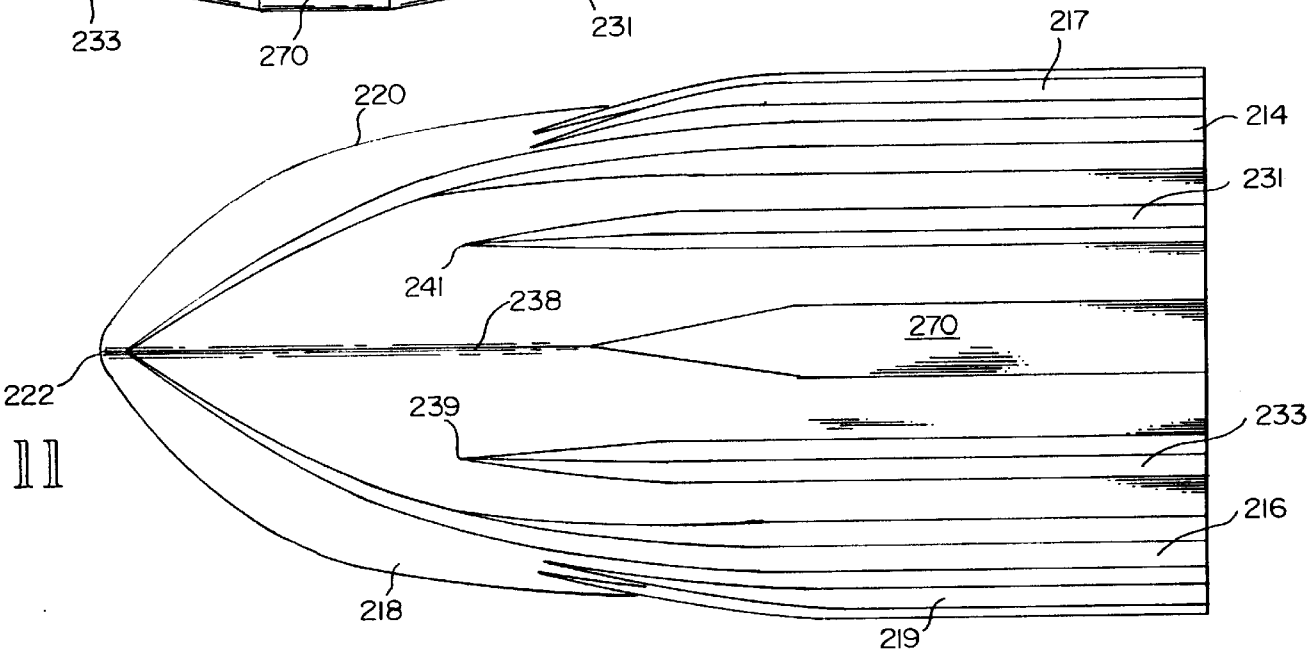
FIG. 11 is a bottom plan view of the boat hull shown in FIG. 10.
Figure 12:
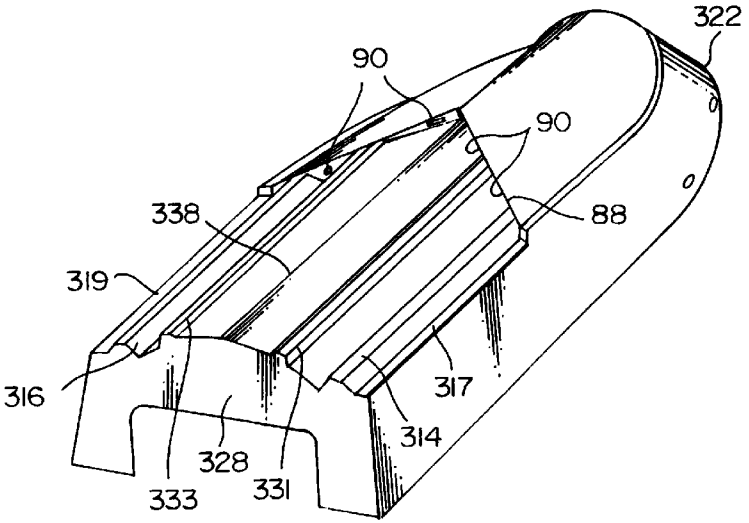
FIG. 12 is a bottom perspective view of another embodiment of this invention showing a modified bow section and provision for introduction of air into the tunnels from a swept back step.
Figure 15:
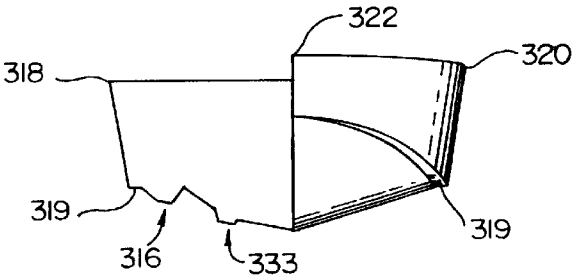
FIG. 15 is a front elevational view partly cut away of the device shown in FIG. 12.
Figure 13:
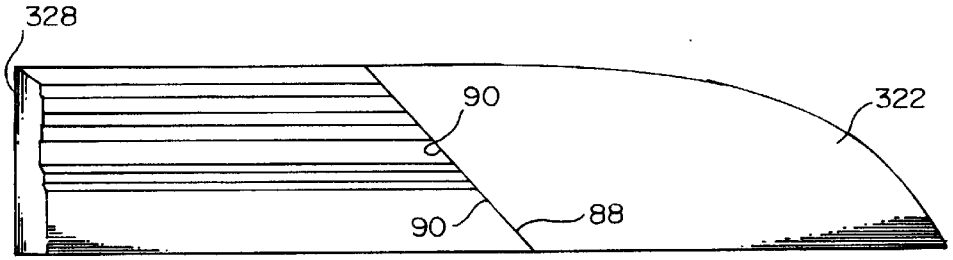
FIG. 13 is a partial bottom plan view of the hull shown in FIG. 12 inverted.
Figure 14:
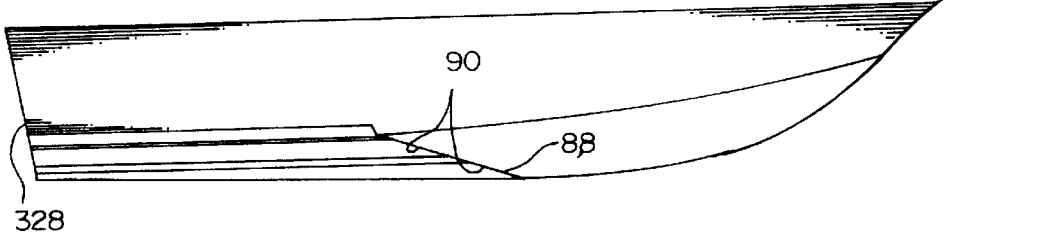
FIG. 14 is a side elevational view of the device shown in FIG. 12.
Figure 16:
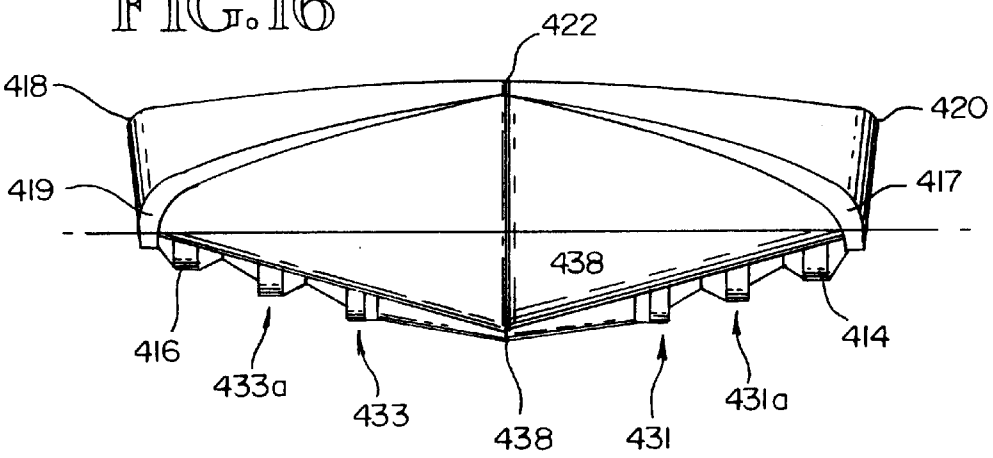
FIG. 16 is a front elevational view of a larger hull having multiple sponson structures positioned at intervals across the width of the hull in a substantially parallel configuration to define multiple tunnels.
Figure 17:
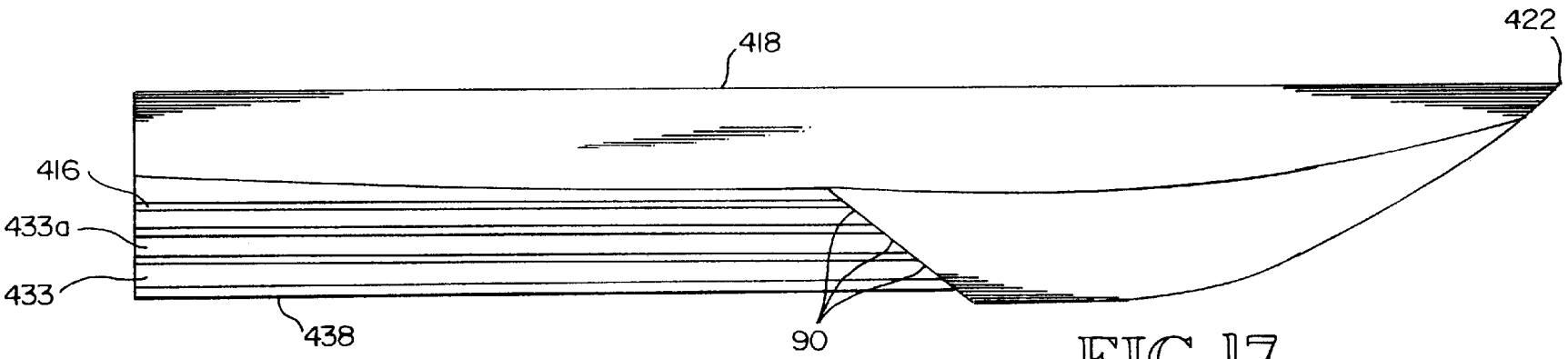
FIG. 17 is a side elevational view of the device shown in FIG. 16.
Figures 18, 19:
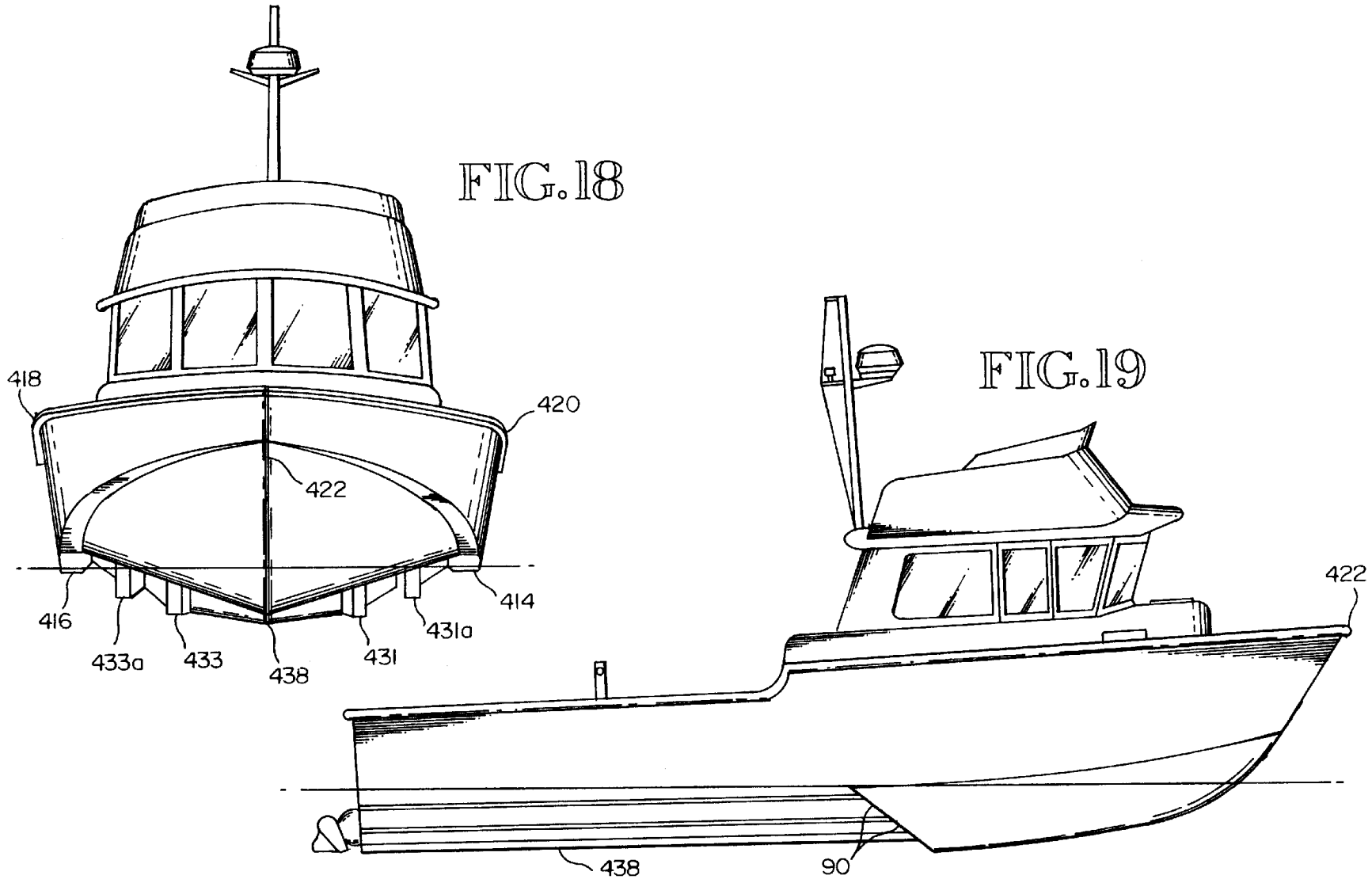
FIG. 18 is a front elevational view of the device shown in FIG. 16 in a patrol boat version.
FIG. 19 is a side elevational view of the apparatus shown in FIG. 18.

The embodiment shown in FIGS. 10 and 11 is particularly well suited to the need for a wider, more stable hull with additional flotation provided in the outermost sponson area 80, 81. In common with the previously described embodiments, the device shown in FIGS. 10 and 11 combine a multiple tunnel forming configuration in which lift is provided on a central, generally v shaped area with provision to capture spray lift. Running surfaces on the sponsons provide lift and stability. The tunnels act as lift areas enhanced by the air entrainment or in some versions by air induction or injection so that a bubble interface at the hull surface is formed to decrease friction and enhance lift. The unique spray capture configuration reduces or eliminates wake as the hull traverses the water. This configuration may readily be adapted to existing hull designs since the outer sponsons extend outwardly from the conventional hull line. A highly efficient hull results having higher Transport Factors and Volumetric Froude Numbers as compared to prior art boat hulls. Other elements of the embodiment shown in FIGS. 10 and 11 are similar to comparably disposed elements shown in FIGS. 1–5 and are similarly labeled, prefaced with the number "2".

Figure 20:
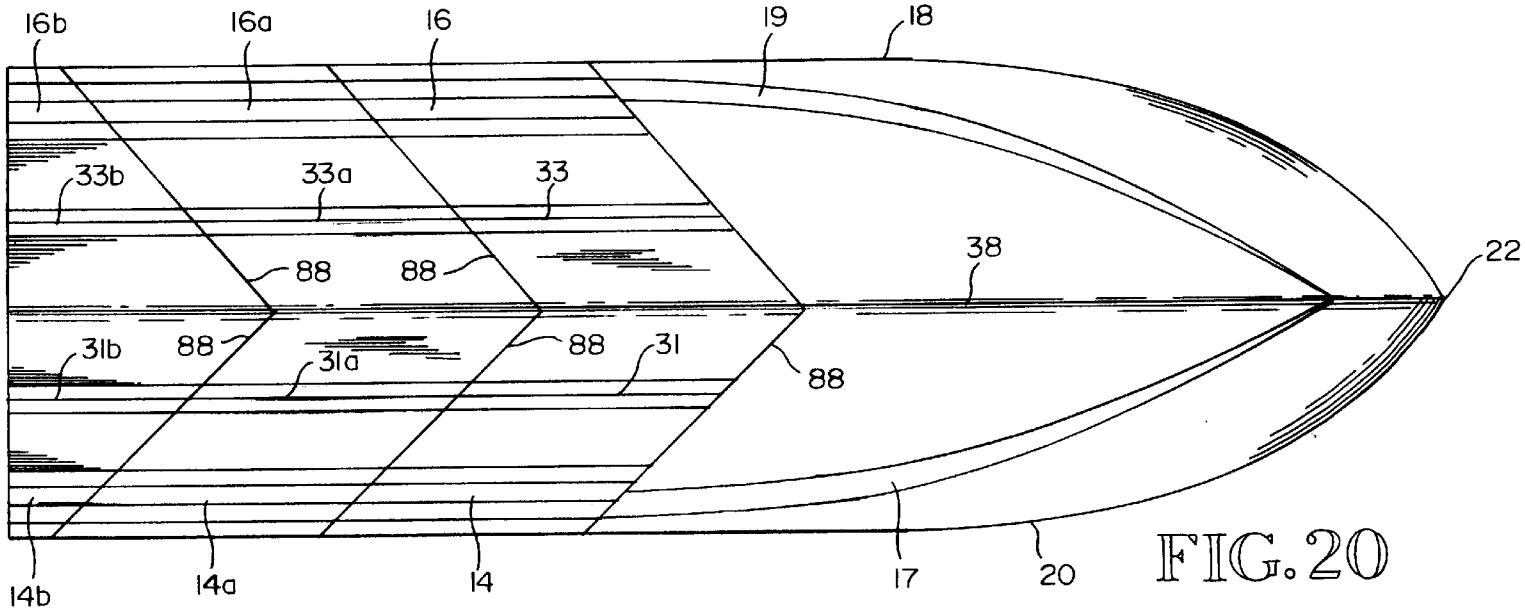
FIG. 20 is a bottom plan view of another embodiment of this invention in which there are a plurality of steps positioned along the bottom surface of the hull to enhance and control air entrainment and injection at a plurality of locations.

In FIGS. 12–15, a further modification of the hull of FIGS. 1–4 is presented in which a modified bow section provides for a step transition into the previously described hull. The step transition is uniquely configured in a swept back v configuration with air injectors 90 for introduction of air into the tunnels. Conventional step structures adapted to induce air into prior art tunnel structures are positioned perpendicular to the centerline or swept forward in an attempt to induce air flow. The configuration of FIGS. 12–15 and the multiple step version of FIG. 20 provide a unique method of inducing air flow with smooth ride. Elements comparable to those described above are labeled similarly with the prefix number "3".

In FIGS. 16–19, larger boat hulls are depicted in which multiple tunnel forming sponsons are disposed across the hull bottom as shown. The patrol boat version of the hull of this invention shown schematically in FIGS. 16–19 would be in the range of about 30 to 100 feet in length and have a beam dimension of from about 12 to 50 feet. Typically, a 42 foot patrol boat would be designed with two longitudinal sponsons with substantially flat running surfaces thereon positioned on each side of the keel to form two tunnel structures while a 100 foot patrol boat would have five to seven longitudinal sponsons with substantially flat running surfaces thereon positioned on each side of the keel to form five to seven tunnels. Other elements of the embodiment shown in FIGS. 16–19 are similar to comparably disposed elements shown in FIGS. 1–5 and are similarly labeled, prefaced with the number "4".

Larger hulls may be constructed using the concepts of the inventions described above by enlarging the design and incorporating even more longitudinal sponsons with flat running surfaces arrayed across the hull surface to form additional tunnel structures. With air injection, enhanced lift and running efficiency, as well as significant wake reduction results. Length to beam ratios of up to 2:1 are feasible for large ships such as aircraft carriers and cargo vessels with remarkably improved efficiency and handling.

Figure 22:
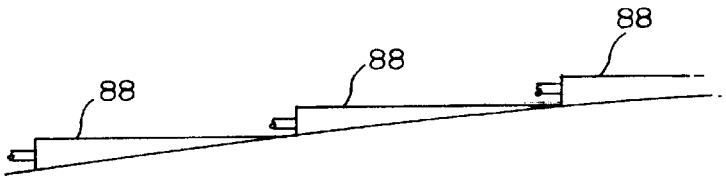
FIGS. 21 and 22 are alternative air injection structures.
Figure 21:
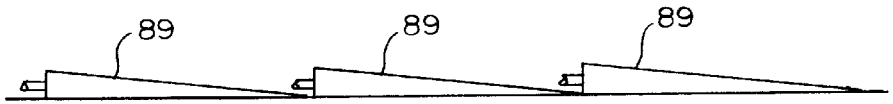

Alternative air injection or inducement structures are envisioned for the hull designs described above, as is shown in FIGS. 20–22. In FIG. 20, multiple swept back steps 88, similar in configuration to the step structure 88 shown in FIGS. 12–15 are shown advantageously positioned along the length of the boat hull. By using multiple steps, the air inducement or injection can be effectively controlled to provide optimum bubble formation and lift along the length of the boat hull. Two alternative air inducement or injection means are schematically shown in FIGS. 21 and 22. In FIG. 21, the air is injected through ports recessed into the surface of the hull 99 while in FIG. 22, a step configuration is used. In each configuration of the air induction means, air is provided at the water hull interface to provide lift and reduce frictional drag in the tunnels defined by the longitudinal sponsons. Individualized control of air volumes entering the various hull areas will permit operational optimization.

Certain load carrying and efficiency aspects of a boat hull may be described and compared to other hull configurations by calculating two well known hull parameters, the Transport Factor and the Volumetric Froude Number. When graphically presented as more fully described below, these parameters present a descriptive comparison of hull properties.

Transport Factor is calculated using the following equation:

$$T.F. = 6.88 V_k D_{1t} / BHP$$

Where $V_k$ is the hull velocity in Knots $D_{1t}$ is the displacement of the hull in long tons $BHP$ is the brake horsepower Volumetric Froude Number is calculated using the following equation:

$$F_D = 0.165 V_k / D_{1t}^{1/6}$$

Figure 23:
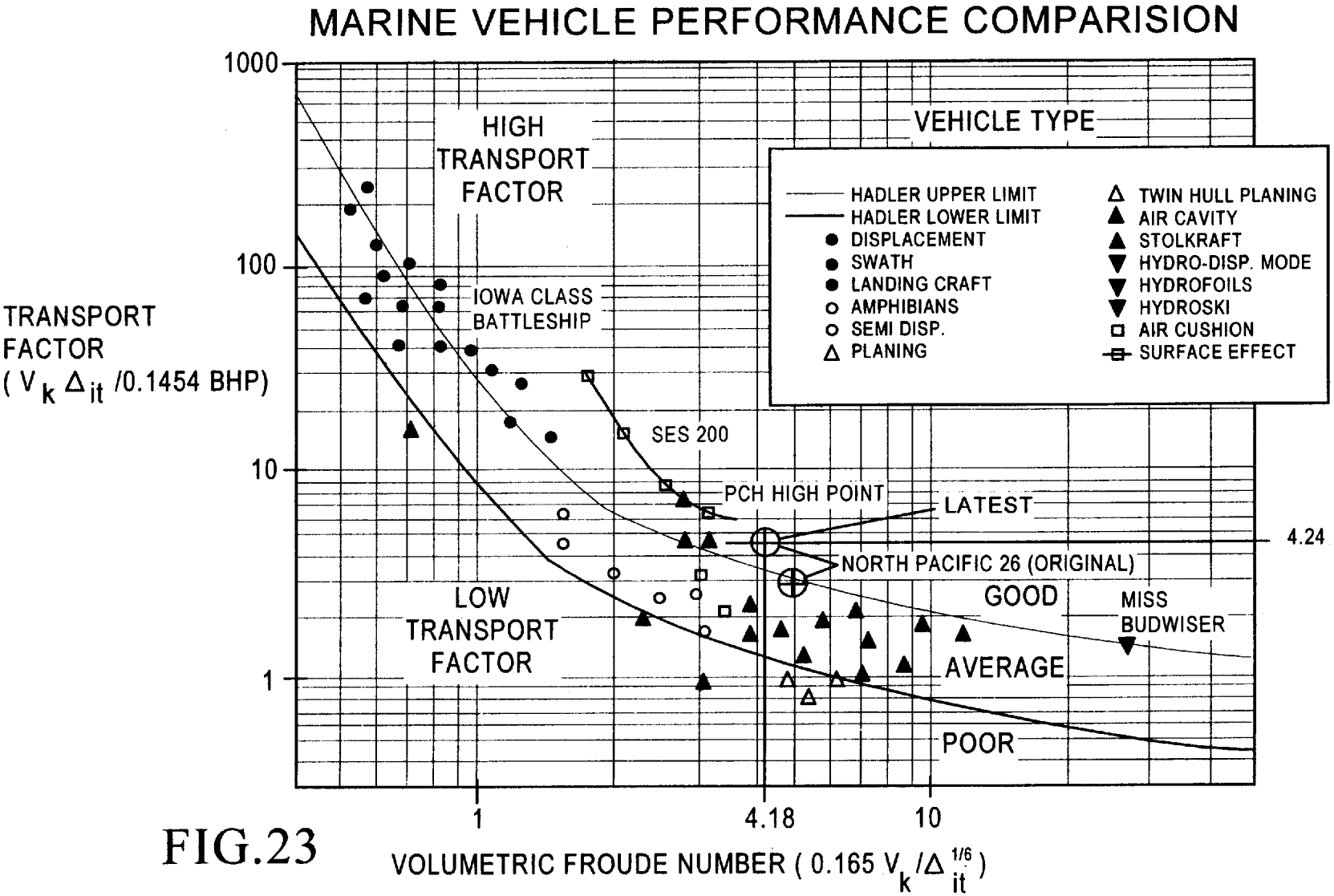
FIG. 23 is a graphical representation of Transport Factor plotted against volumeitc Froude Number for various boat hulls.

A plot of the Transport Factor vs the Volumetric Froude Number for various hulls obtained from the David Taylor Model Basin in Maryland is shown in FIG. 23. The data for hulls described herein incorporating the invention compares very favorably with the best designed hulls of the prior art.

Data obtained from various sources and assembled at the David Taylor Model Basin for various small craft is presented in tabular form below. The highest transport factor for all small boat hulls studied is the hull constructed according to the teachings of this invention and described in Example 3 below, using the 200 horsepower Mercury engine.

TABLE 1

| Vehicle's Name | Vehicle's Type | Vehicle's Mode | Engine BPH | Length (ft) | Diapl'mnt (longtone) | Max Spd (kts) | Volum. Froude | Transport Factor |
|---|---|---|---|---|---|---|---|---|
| Roth Bitt | Pleasure Craft | Stepped | 50 | 16.00 | 0.40 | 30.4 | 5.82 | 1.88 |
| Master Craft Pro State 190 | Sailboat | Planing | 255 | 19.00 | 1.12 | 38.2 | 6.17 | 1.15 |
| Chaparal 204 Fisherman | Pleasure Craft | Planing | 150 | 19.25 | 1.12 | 38.5 | 5.90 | 1.87 |
| Four Winds 207 Quest CC | Cabin Cruiser | Planing | 150 | 19.83 | 1.34 | 39.1 | 6.13 | 2.40 |
| Shamrock 200 Walkthru | Motor Yacht | Planing | 130 | 20.00 | 1.45 | 25.1 | 4.03 | 2.00 |

TABLE 1-continued

| Vehicle's Name | Vehicle's Type | Vehicle's Mode | Engine BPH | Length (ft) | Diapl'mnt (longtone) | Max Spd (kts) | Volum. Froude | Transport Factor |
|---|---|---|---|---|---|---|---|---|
| Shamrock 200 Walkthru | Motor Yacht | Planing | 215 | 20.00 | 1.45 | 34.7 | 5.38 | 1.51 |
| Aquasport | Cabin Cruiser | Planing | 150 | 20.00 | 1.03 | 39.1 | 6.41 | 1.84 |
| Elite Craft old style | Classic | Planing | 220 | 20.00 | 1.34 | 39.1 | 6.13 | 1.64 |
| Proline 17 walkaround | Cabin Cruiser | Planing | 88 | 20.50 | 1.29 | 28.7 | 4.52 | 2.90 |
| Correct Craft Fish Nautique | Pleasure Craft | Planing | 240 | 23.00 | 1.79 | 36.5 | 5.45 | 1.87 |
| Grady White Gulfstream | Fishing | Planing | 230 | 23.42 | 1.80 | 38.2 | 5.71 | 2.05 |
| Pursuit 2550 | Pleasure Craft | Planing | 300 | 24.75 | 1.50 | 41.7 | 6.41 | 1.43 |
| Donzi | Performance | Planing | 260 | 25.00 | 2.23 | 38.2 | 5.50 | 2.25 |
| North Pacific 26 | Pleasure Craft | Tunnel | 115 | 26.00 | 1.79 | 31.0 | 4.63 | 3.31 |
| North Pacific 26 | Pleasure Craft | Tunnel | 200 | 26.00 | 3.88 | 31.7 | 4.14 | 4.24 |
| Bayliner 2855 Sunbridge | Pleasure Craft | Planing | 340 | 27.58 | 2.95 | 36.4 | 5.01 | 2.17 |
| Hustler Cobalt | Performance | Planing | 540 | 28.00 | 2.23 | 60.8 | 8.76 | 1.73 |
| Northstar 28 | Pleasure Craft | Planing | 520 | 28.00 | 4.24 | 34.0 | 4.40 | 1.91 |
| Blacktin 29 SF | Sport Fisherman | Planing | 630 | 29.30 | 5.58 | 32.0 | 3.96 | 1.95 |
| Chaparal Villain | Performance | Planing | 730 | 30.00 | 3.90 | 62.5 | 8.44 | 1.95 |
| Pursuit 2800 | Performance | Planing | 400 | 30.33 | 2.90 | 47.8 | 8.59 | 2.38 |
| Bayliner 3255 Avarti Sunb | Pleasure Craft | Planing | 470 | 31.58 | 4.98 | 32.0 | 4.04 | 2.32 |
| Bayliner 3255 Avanti Sunb | Pleasure Craft | Planing | 520 | 91.58 | 5.00 | 40.0 | 5.04 | 2.65 |
| Marinette 41 | Performance | Planing | 700 | 41.00 | 7.77 | 28.7 | 3.35 | 2.19 |
| Stolkraft 450 | Pleasure Craft | Cavity | 830 | 44.50 | 10.18 | 41.8 | 4.88 | 3.53 |

The boat hull described in various embodiments herein can be constructed from any of the usual boat-building materials such as fiberglass reinforced polymers, aluminum, steel, other metals, wood and the various sheet plastics. It may be constructed as a unitary structure or be manufactured in modular elements which are later assembled into the finished hull structure. Interior strengthening beams, ribs and the like may be used to provide adequate strength for the purpose intended. It is contemplated that the hull described herein may be used in small craft as well as larger, ocean-going high speed craft. The excellent performance and unique handling characteristics of this hull design makes the boats equipped with these features desirable for use as patrol boats, high speed ocean going racers and many other uses.

EXAMPLE 1

A boat hull was constructed from an existing seventeen foot long hull form by having the new bottom "grafted" onto it to form a boat having a beam of approximately eight feet and a hull configuration substantially as shown in FIGS. 1–5. It performed admirably, hinting at the potential of the design. From the first speed and loading tests, it was obvious this design was a decided improvement in performance from what had been done before. This first hull construction was run extremely hard, testing her beyond normal limits with extreme weight loads at high speeds. She was damaged in one speed test and filled with water. While filled, she was able to plane until the trailer was in the water, and they were able to drive the sinking boat onto the trailer. Really intrigued by this performance, the boat was repaired and testing began anew. The boat was found to be overweight, having more beam to length than desired, and the new sponsons were faired too tightly into the hull. This caused drag in high wave conditions, but with a 115 HP outboard she still clocked over 50 MPH with a radar gun. Unfortunately, the second repair was inadequate and the boat was retired before fully tested. It was decided to build a larger boat that would test the inventor's theories as applied to boats from sixteen to over thirty feet in length.

EXAMPLE 2

Using the information learned from the boat described in Example 1, the new prototype was built in aluminum for strength and possibly to be used as a plug when the prototype phase was over. Built heavy with all 3/16 inch plate in the configuration shown in FIGS. 1–4, the boat weighed approximately 4000 pounds. At eight feet, her beam is the same as the first prototype so the beam/length ratio is a little closer to normal, with an overall length of 26 feet 6 inches. She was initially fitted out with running rigging and a 115 HP Yamaha outboard engine. Fully loaded at approximately 1.79 long tons displacement (including water in barrels for the test procedure) the boat achieved speeds of 31 miles per hour and was calculated to have a Volumetric Froude Number of 4.63 with a transport factor of 3.31. With adequate power, she is projected to well exceed the target speed of 45 to 50 MPH.

EXAMPLE 3

The boat hull described in Example 2 modified as shown in FIGS. 12–15, was fitted out with a 200 horsepower Mercury Engine and tested with a gross weight of 8700 pounds including crew and observers. When running at maximum engine speed recorded of 5850 rpm, the boat loaded as described achieved 36.5 miles per hour in one test and 36.0 miles per hour in the second test. These tests resulted in a Transport Factor of 4.24 and a Volumetric Froude Number of 4.18.

The Design

FIG. 1 generally shows the hull lines of the second prototype in perspective. What one sees is a fairly complex bottom at first glance. However, as you look, you will note that there are actually two bottoms here. The fast riding bottom and the stable low speed bottom. The deadrise angle is quite low on the fast riding bottom. This equates to speed. From the center V-hull section out to the outer sponson, you will note the deadrise is similar to that of a deep V-hull. This forms a pocket with the outer sponson which also has considerable deadrise with flat lifting surface on the bottom. These sponsons are called hydro-sponsons as they do multiple duty in the design. You will note the multiple lifting surfaces. Even when heavily loaded with water, Prototype One was able to plane easily because of these lifting surfaces.

The inventors theorize that when power is applied to this hull and it moves forward, the lifting surfaces cause the hull to rise. As the boat lifts, more and more hull comes free of the water, reducing drag. As speed is built and the angle of attack is fairly high, air pressure builds in the tunnels created by the hydrosponsons and the center hull section. This pressure helps to further lift the boat. With little effort and very quickly, the hull levels on plane with most of the bottom out of the water riding on the center bottom, the sponson running surfaces and a cushion of air in the tunnels. At speed, the hull is stabilized by spray hitting the hydrosponsons which has the dual result of providing lift and decreasing or eliminating the signature wake.

In a high speed turn, the hull will bank only a little for comfortable "feel", but it can bank no further than the angle allowed by the hydrosponson. It does not "fall over" as is so typical of many deep V-types. When rough water is encountered, the center flat hull section is small enough that it offers little resistance to waves. The wave rushes past the flat bottom and encounters the air in the tunnel. This acts as a cushion, effectively dampening the impact of the wave. (Moisture laden air actually has been observed rushing out either end of the tunnel in these conditions upon wave impact.) The lifting surfaces bring the boat immediately on plane again, and the whole sequence starts over.

With the first prototype, it was found that varying the angle of attack of the hull to the water surface could significantly improve comfort without affecting speed significantly. In trips across rough water found in the Straits of Juan de Fuca, one could drive the boat at 37 knots, but it was much more comfortable in sloppy conditions to trim the bow a little high and slow the boat to 32–33 knots. It is believed that this causes the tunnel to fill with compressed air as the angle of attack would serve to close off the aft end of the tunnel effecting an air cushion. (It should also be noted that the design of Prototype One was impaired by the fairing of the hydrosponsons into the utilized hull. This caused her speed to drop when larger waves hit this bluff fairing, lowering her speed.

With the hull structure described herein it is possible to support a larger beam to length ratio with no compromise in performance. This allows for more load carrying and more stability The hull structures described herein achieve a plane very easily at lower horsepower. The boat hulls of this invention will perform at higher speeds with substantially less horsepower resulting in a hull form that is more economical than the devices of the prior art. The hull appears to have easy riding attributes that are as significant as the deep V without resulting loss of stability and efficiency. The speed potential of this hull form has yet to be fully explored. It appears she is very, very fast with moderate horsepower. We intend to explore the limits with a variety of outboard and inboard combinations in Prototype Two. Based on experience the hulls described herein have a very broad range of applications from pleasure to commercial/military.

In compliance with the statute, the invention has been described in language more or less specific as to structural features. It is to be understood, however, that the invention is not limited to the specific features shown, since the means and construction herein disclosed comprises a preferred form of putting the invention into practice. The invention is, therefore, claimed in any of its forms or modifications within the legitimate and valid scope of the appended claims, appropriately interpreted in accordance with the doctrine of equivalents.

What is claimed is:

1. A hull for a boat adapted for operation on a water surface, said hull having a bow section, a mid hull section, a keel and a stern, comprising:

a center V-hull portion extending substantially from said bow to said stern, and including a pair of angled panels symmetrically positioned about a hull center plane, said panels defining a V-hull apex line, said angled panels each defining a V-hull dead rise angle measured from said apex line relative to a normal plane containing said apex line and perpendicular to said hull center plane;

at least one set of first and second opposed mid hull sponsons, positioned upon said mid hull section on opposite sides of said V-hull portion, each mid hull sponson including a substantially horizontally disposed running surface and connected to said V-hull portions by reverse deadrise panels, whereby said mid-hull sponsons, and said V-hull portion, together with said water surface, define a pair of mid-hull air capturing tunnels while minimizing the wetted surface area of said mid-hull sponsons;

first and second outer V-hull panels extending outwardly and upwardly from said mid hull sponsons;

first and second opposed outer sponsons, positioned on opposite sides of said outer V-hull panels, each outer sponson including a lower most running surface and connected to said outer V-hull panels by second reverse deadrise panels, whereby said outer sponsons, and said V-hull panels, together with said water surface, define a pair of outer air capturing tunnels while minimizing the wetted surface area of said mid-hull sponsons; and gunwales extending upwardly from said outer sponsons.

2. A hull as claimed in claim 1, wherein each of said outer sponsons further comprise an outer sidewall oriented between 40 degrees and 60 degrees to the horizontal.

3. A hull as claimed in claim 2, wherein said lowermost running surface interconnects said inner and outer sidewalls on each of said outer sponsons.

4. A hull as claimed in claim 1, said outer sponsons each extending from a sponson point ahead of the midsection of said hull to the stern of said hull and oriented generally parallel to the longitudinal axis of said hull, whereby air deflected from said V-hull portion as said hull moves through the water is captured by said sponson forward portions and directed rearwardly through said mid-hull air capturing tunnels.

5. A hull as claimed in claim 1 wherein said mid-hull sponsons extend from a mid-hull sponson point ahead of midsection of said hull to said stern whereby air deflected from said V-hull portion as said hull moves through the water is captured by said mid-hull sponson forward portions and directed rearwardly through said outer air capturing tunnels.

6. A hull as claimed in claim 1, wherein a plurality of said mid hull sponsons are disposed between said keel and said outer sponsons, adjacent mid hull sponsons forming air capturing tunnels.

7. The hull of claim 1, further including step means positioned aft of said bow section, said step means diverging from said keel toward said stern.

8. The hull of claim 7, wherein said step means comprises a plurality of spaced apart steps.

9. The hull of claim 7, wherein said step means includes air injection means to insert air into said tunnels.

10. The boat hull of claim 1 having a bow section, a mid hull section, a heel and a stern, said hull having a step means positioned aft of said bow section on said mid hull section, said step diverging from said keel toward said stern.

11. The boat hull of claim 10, wherein said step means comprises a plurality of steps each diverging outwardly from said keel toward said stern.

* * * * *